US007315813B2

(12) United States Patent
Kuo et al.

(10) Patent No.: US 7,315,813 B2
(45) Date of Patent: Jan. 1, 2008

(54) METHOD OF SPEECH SEGMENT SELECTION FOR CONCATENATIVE SYNTHESIS BASED ON PROSODY-ALIGNED DISTANCE MEASURE

(75) Inventors: Chih-Chung Kuo, Hsin-Chu (TW); Chi-Shiang Kuo, Chungho (TW)

(73) Assignee: Industrial Technology Research Institute, Chutung, Hsinchu (TW)

( * ) Notice: Subject to any disclaimer, the term of this patent is extended or adjusted under 35 U.S.C. 154(b) by 854 days.

(21) Appl. No.: 10/206,213

(22) Filed: Jul. 29, 2002

(65) Prior Publication Data

US 2003/0195743 A1 Oct. 16, 2003

(30) Foreign Application Priority Data

Apr. 10, 2002 (TW) ..... 91107180 A

(51) Int. Cl.
*G10L 11/04* (2006.01)

(52) U.S. Cl. ..... 704/207; 704/258; 704/260; 704/238

(58) Field of Classification Search ..... 704/260, 704/258, 238, 239, 266, 270, 270.1, 207
See application file for complete search history.

(56) References Cited

U.S. PATENT DOCUMENTS 6,665,641 B1 * 12/2003 Coorman et al. ..... 704/260
6,950,798 B1 * 9/2005 Beutnagel et al. ..... 704/260

* cited by examiner

*Primary Examiner*—Huyen X. Vo
(74) *Attorney, Agent, or Firm*—Bacon & Thomas, PLLC

(57) ABSTRACT

A method of speech segment selection for concatenative synthesis based on prosody-aligned distance measure is disclosed. This method is based on comparison of speech segments segmented from a speech corpus, wherein speech segments are fully prosody-aligned to each other before distortion measure. With prosody alignment embedded in selection process, distortion resulting from possible prosody modification in synthesis could be taken into account objectively in selection phase. In order to carry out the purpose of the present invention, automatic segmentation, pitch marking and PSOLA method work together for prosody alignment. Two distortion measures, MFCC and PSQM are used for comparing two prosody-aligned segments of speech because of human perceptual consideration.

11 Claims, 2 Drawing Sheets

METHOD OF SPEECH SEGMENT SELECTION FOR CONCATENATIVE SYNTHESIS BASED ON PROSODY-ALIGNED DISTANCE MEASURE

BACKGROUND OF THE INVENTION

1. Field of the Invention

The present invention relates to the field of speech synthesis, and more particularly, to a method of speech segment selection for concatenative synthesis based on prosody-aligned distance measure.

2. Description of Related Art

Currently, the method of concatenative speech synthesis based on a speech corpus has become the major trend because the resulted speech sounds more natural than that produced by parameter-driven production models. The key issues of the method include a well-designed and recorded speech corpus, manual or automatic labeling of segmental and prosodic information, selection or decision of synthesis unit types, and selection of the speech segments for each unit type.

Early synthesizer is built by directly recording the 411 syllable (unit segment) types in a single-syllable manner in order to select Chinese speech segments. It makes the segmentation easier, avoids co-articulation problem, and usually has a more stationary waveform and steady prosody. However, the synthetic speech produced by the speech segments extracted from single syllable recording sounds unnatural, and this kind of speech segments is not suitable for multiple segment units selection. This is because neither natural prosody nor contextual information could be utilized in a single syllable recording system.

In order to solve the above problem, there is provided a continuous speech recording system whereby both fluent prosody and contextual information can be taken into account. However, this method needs to build a large speech corpus which needs manual intervention, so that it becomes labor-intensive and is prone to come into inconsistent results.

U.S. Pat. No. 6,173,263 discloses a method and system for performing concatenative speech synthesis using half-phonemes. In such a method, a half-phoneme is a basic synthetic unit (candidate), and a Viterbi searcher is used to determine the best match of all half-phonemes in the phoneme sequence and the cost of the connection between half-phoneme candidates. U.S. Pat. No. 5,913,193 discloses a method and system of runtime acoustic unit selection for speech synthesis. This method minimizes the spectral distortion between the boundaries of adjacent instances, thereby producing more natural sounding speech. U.S. Pat. No. 5,715,368 discloses a speech synthesis system and method utilizing phoneme information and rhythm information. This method uses phoneme and rhythm information to create an adjunct word chain, and synthesizes speech by using the word chain and independent words. U.S. Pat. No. 6,144,939 discloses a formant-based speech synthesizer employing demi-syllable concatenation with independent cross fade in the filter parameter and source domains. In such a method, concatenation of the demi-syllable units is facilitated by a waveform cross fade mechanism and a filter parameter cross fade mechanism. The waveform cross fade mechanism is applied in the time domain to the demi-syllable source signal waveforms, and the filter parameter cross face mechanism is applied in the frequency domain by interpolating the corresponding filter parameters of the concatenated demi-syllables.

However, none of the aforesaid prior arts estimates the distortion resulted from prosody modification in the synthesis phase when selecting the synthesis unit. Using the concept of synthesizer-embedding in the analysis phase, the distortion measure is related objectively and corresponds highly to the actual quality of the synthetic speech.

SUMMARY OF THE INVENTION

The object of the present invention is to provide a method of speech segment selection for concatenative synthesis based on prosody-aligned distance measure, which integrates the subsequent prosody modification scheme to search for the best segment that minimize the total acoustic distortion with respect to a training corpus, avoids those speech segments with odd spectra and those speech segments that are badly segmented or pitch-marked, and makes the synthetic speech sound more natural.

To achieve these and other objects of the present invention, the method of speech segment selection for concatenative synthesis based on prosody-aligned distance measure comprises the steps of: (A) segmenting speech stored in a speech corpus into at least one speech segment according to a unit type, wherein each speech segment has its prosody information; (B) locating pitch marks for each speech segment; (C) selecting one of the speech segment according to the unit type as a source segment and other speech segments as target segments, and performing a prosody alignment between the source segment and each target segment to obtain a prosody-aligned source segment, wherein the pitch marks of the prosody-aligned source segment are aligned with the pitch marks of the target segment; (D) measuring distortion between the prosody-aligned source segment and each target segment to obtain a distance between the prosody-aligned source segment and each target segment, and to obtain an average distance between the prosody-aligned source segment and each target segment; and (E) selecting at least one speech segment with a relative small average distance.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
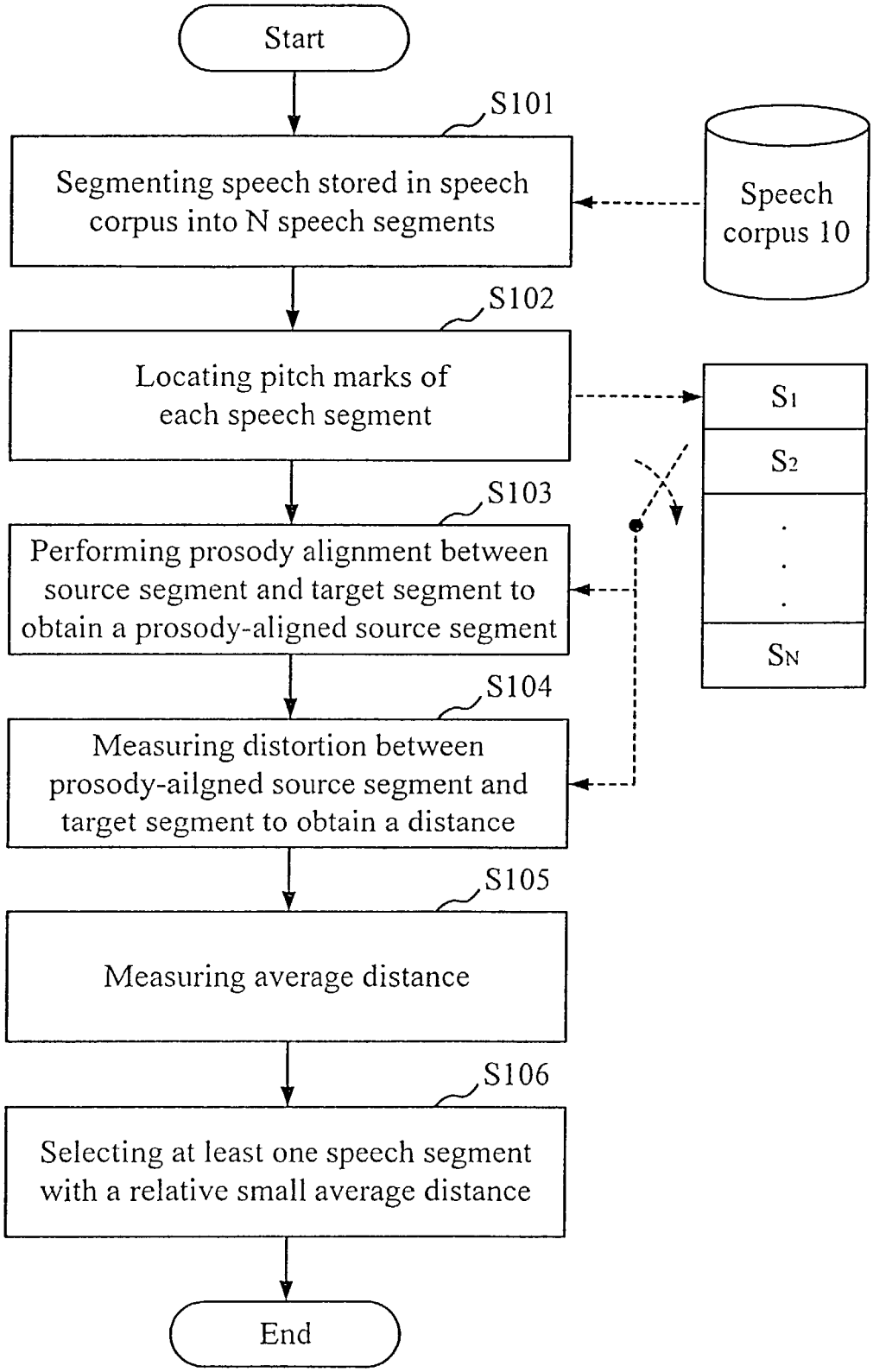
FIG. 1 is a flow chart showing the operation of the present invention.

With reference to FIG. 1, there is shown a preferred embodiment of the process of speech segment selection for concatenative synthesis based on prosody-aligned distance measure in accordance with the present invention. In this embodiment, it can automatically select synthetic speech units from a speech corpus 10 for processing concatenative synthesis, wherein the speech corpus 10 is recorded with a variety of speech data including primitive speech waveform with corresponding text transcription.

In order to select specific synthetic speech units, speech data stored in speech corpus 10 will be segmented into N speech segments according to a unit type (S401). Those N speech segments are denoted as $S_1, S_2, \ldots$, and $S_N$, and each speech segment has prosody information in accordance with its energy, duration, pitch, and phase. The unit type can be a syllable, a vowel, or a consonant. In this embodiment, the unit type is preferably a syllable, and the syllable is composed of a vowel as a basis and at least 0 consonant to modify the vowel. Due to a great deal of speech data stored in the speech corpus 10, it can substantially enhance the efficiency and accuracy of speech synthesis by using a computer system to perform automatic segmentation. In this embodiment, the computer system uses Markov modeling algorithm to perform automatic segmentation.

In step S102, pitch marks are respectively located for each speech segments $S_1, S_2, \ldots$, and $S_N$. In each speech segment, pronunciation of a vowel procures a periodic appearance of its pitch impulse, wherein the strongest impulse of each pitch period is the location of pitch mark.

Figure 2:
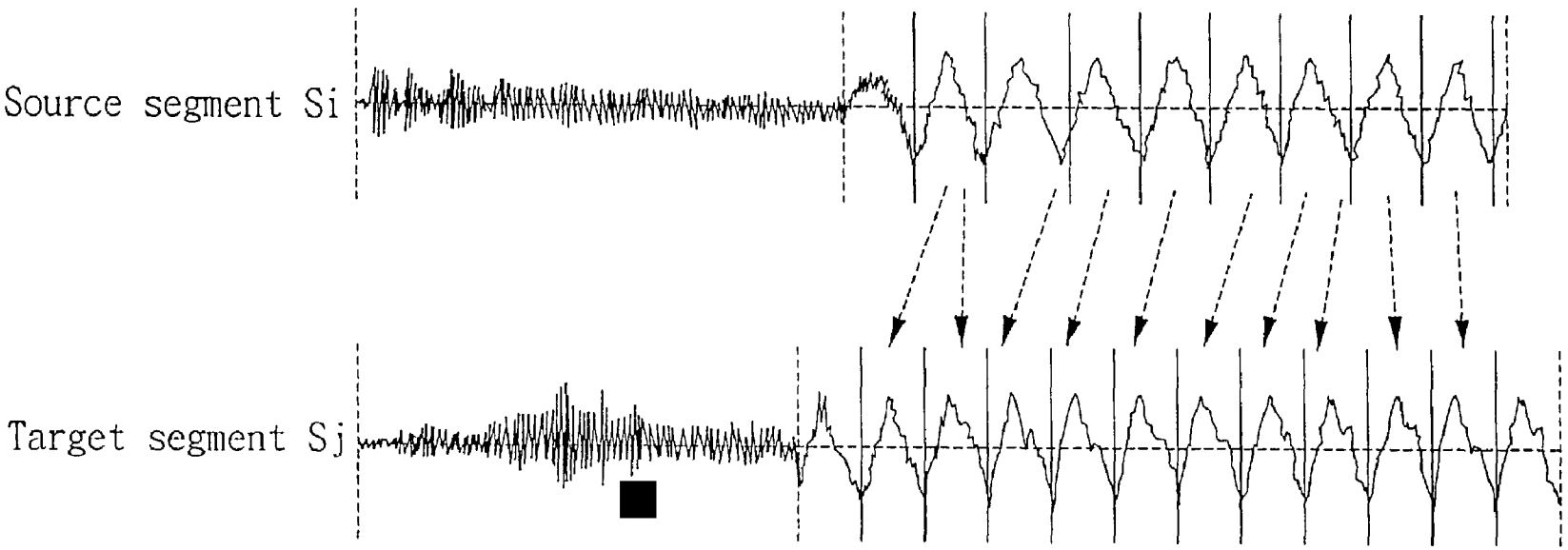
FIG. 2 is a schematic drawing showing the prosody of the source segment modified according to the prosody of the target segment.

For the purpose of comparing differences between different speech segments according to the same unit type, one of N speech segments is selected as a source segment $S_i$, and the other (N−1) speech segments are defined as target segments $S_j$. Then a pitch synchronous overlap-and-add (PSOLA) algorithm is adapted for performing prosody alignment between the source segment $S_i$ and each target segment $S_j$ to obtain a prosody-aligned source segment $\hat{S}_i$, wherein the pitch marks of the prosody-aligned source segment $\hat{S}_i$ are time-aligned and pitch-aligned with that of the target segment $S_j$ (S103). With reference to FIG. 2, prosody (energy, duration, pitch, and phase) of source segment $S_i$ is modified according to prosody of target segment $S_j$. For example, if $S_1$ is source segment, its prosody would be respectively modified as prosody of target segment $S_2, S_3, \ldots$, and $S_N$; if $S_2$ is source segment, its prosody would be respectively modified as prosody of target segment $S_1, S_3, \ldots$, and $S_N$; and so on.

Then, distortion between the waveform of prosody-aligned source segment and original waveform of each (N−1) target segment is respectively measured to obtain the distance between prosody-aligned source segment and each target segment according to the function as follows (S104):

$$D_{ij}=\mathrm{dist}(\hat{S}_i<S_j>,S_j),$$

wherein $\hat{S}_1<S_j>$ is the waveform modified from source segment $S_i$ according to the prosody of target segment $S_j$; that is, $\hat{S}_i<S_j>$ is the waveform of prosody-aligned source segment. In this embodiment, a Mel-frequency cepstrum coefficients (MFCC) algorithm is preferably adapted for measuring distance $D_{ij}$ to obtain differences between speech segments with different frequency bands. The Mel-scale frequency is defined by experiments of psychoacoustics, which reflect the different human sensitivity to different frequency bands. Furthermore, a perceptual speech quality measure (PSQM) algorithm can also be adapted for measuring distance $D_{ij}$.

According to aforesaid steps, in case one speech segment is selected as source segment, distortion measure will be respectively performed between this selected speech segment and the other (N−1) speech segments to obtain (N−1) distances $D_{ij}$. In step 105, an average distance is obtained by dividing the summation of (N−1) distances by (N−1). Taking the i-th speech segment $S_i$ as a source segment, the average distortion for $S_i$ is:

$$D_i = \frac{1}{N-1}\sum_{\substack{j=1\\ j\neq i}}^{N} D_{i,j}.$$

Finally, at least one speech segment with a relative small average distance $D_i$ is selected by the inverse function expressed as follows (S106):

$$i=\arg\{D_i\}.$$

It is preferred to select the speech segment with the smallest average distance $D_i$. and the inverse function can be expressed as follows:

$$i_{opt} = \arg\min_i\{D_i\}.$$

In view of the foregoing, it is known that the present invention can directly select synthetic speech unit from the speech data of a whole sentence stored in the speech corpus according to the prosody-modification mechanism embedded in the synthesizer. Because the speech data of whole sentence comprises the prosody information of each speech segment, the prosody has been taken into account in each step including segmenting speech information, locating pitch marks, performing prosody alignment, and measuring distortion, so that the optimal synthetic speech unit can be selected directly according to actual acoustic information. Therefore, the present invention can integrate the subsequent prosody modification scheme to search for the best segment that minimize the total acoustic distortion with respect to a well-recorded speech corpus, avoid those speech segments with odd spectra and those speech segments that are badly segmented or pitch-marked, and make the synthetic speech sound more natural. Furthermore, prosody alignment can be implemented by a general synthesizer so that it's not necessary to design another procedure for prosody alignment.

Although the present invention has been explained in relation to its preferred embodiment, it is to be understood that many other possible modifications and variations can be made without departing from the spirit and scope of the invention as hereinafter claimed.

What is claimed is:

1. A method of speech segment selection for use in constructing a concatenative synthesizer's database based on prosody-aligned distance measure, comprising the steps of:

(A) segmenting speech stored in a speech corpus, which is recorded in advance into a plurality of speech segments according to a unit type, wherein each of the speech segments has its prosody;

(B) locating pitch marks for each of the speech segments;

(C) selecting one of the speech segments according to the unit type as a source segment and the remaining speech segments as target segments, and performing a prosody alignment between the source segment and each of the target segments by modifying the prosody of the source segment with a respective prosody of each of the target segments, so as to obtain a prosody-aligned source segment with respect to each of the target segments, wherein the pitch marks of the prosody-aligned source segment are time-aligned and pitch-aligned with the pitch marks of each of the target segments;

(D) respectively measuring distortion between the prosody-aligned source segment and each of the target segments to obtain a distance between the prosody-aligned source segment and each of the target segments, and to obtain an average distance for the prosody-aligned source segment with respect to each of the target segments; and (E) selecting at least one speech segment previously selected as the source segment with a relatively small average distance to be used as a synthetic speech unit of the unit type for constructing the synthesizer's database.

2. The method as claimed in claim 1, wherein in step (A), the unit type is a syllable.

3. The method as claimed in claim 1, wherein in step (A), the speech corpus is automatically segmented into a plurality of speech segments according to a unit type by a computer.

4. The method as claimed in claim 3, wherein the speech is segmented by using a Markov model.

5. The method as claimed in claim 1, wherein in step (C), the prosody alignment is performed between the source segment and each target segment by using a pitch synchronous overlap-and-add (PSOLA) algorithm.

6. The method as claimed in claim 1, wherein in step (D), the distance is $D_{ij}=\mathrm{dist}(\hat{S}_i<S_j>, S_j)$, where $S_i$ is the source segment, $S_j$ is the target segment, and $\hat{S}_i<S_j>$ is the waveform of the prosody-aligned source segment.

7. The method as claimed in claim 6, wherein step (D) measures the distortion between the prosody-aligned source segment and each of the target segments by using a Mel-frequency cepstrum coefficients (MFCC) algorithm.

8. The method as claimed in claim 6, wherein step (D) measures the distortion between the prosody-aligned source segment and each of the target segments by using a perceptual speech quality measure (PSQM) method.

9. The method as claimed in claim 6, wherein the average distance of one speech segment $S_i$ among other speech segments is $$D_i = \frac{1}{N-1}\sum_{\substack{j=1\\ j\neq i}}^{N} D_{i,j},$$

wherein N is the number of speech segments.

10. The method as claimed in claim 9, wherein the value i of the speech segment $S_i$ can be calculated according to an inverse function of the average distance, where the inverse function is $i=\arg\{D_i\}$.

11. The method as claimed in claim 10, wherein the value of i of the speech segment $S_i$ with the smallest average distance can be calculated according to the inverse function $$i_{opt} = \arg\min_i\{D_i\}.$$

* * * * *